United States Patent [19]

Livecchi

[11] Patent Number: 4,918,845

[45] Date of Patent: Apr. 24, 1990

[54] CLAMP TYPE ELECTRIC STEAM IRON STAND

[76] Inventor: Paul M. Livecchi, P.O. Box 27171, San Diego, Calif. 92128

[21] Appl. No.: 273,994

[22] Filed: Nov. 21, 1988

[51] Int. Cl.[5] ..... D06F 75/08; D06F 75/40

[52] U.S. Cl. ..... 38/142; 38/96; 38/107; 219/247; 248/117.6

[58] Field of Search ..... 219/246, 257, 247; 38/96, 107, 79, 88, 91, 142; 108/108, 152, 59; 211/134, 135; 248/117.1–117.7

[56] References Cited

U.S. PATENT DOCUMENTS

| | | | |
|---|---|---|---|
| 868,500 | 10/1907 | Springer | 38/107 X |
| 1,312,349 | 8/1919 | Ossry | 38/107 |
| 1,350,933 | 8/1920 | Oca-Bulda | 219/257 X |
| 1,366,480 | 1/1921 | Oca-Balda | 219/257 X |
| 2,191,649 | 2/1940 | Gey | 248/117.1 |
| 2,470,343 | 5/1949 | Dinger | 108/152 X |
| 2,487,292 | 11/1949 | Aske | 38/107 |
| 2,714,650 | 8/1955 | Werner | 219/247 |
| 3,185,278 | 5/1985 | Miller et al. | 219/246 |
| 3,745,676 | 7/1973 | Dikoff | 38/96 |
| 3,919,950 | 11/1975 | Frazelle et al. | 108/152 X |
| 4,366,366 | 12/1982 | Ekblad | 38/96 X |
| 4,756,430 | 7/1988 | Spamer et al. | 108/108 X |

FOREIGN PATENT DOCUMENTS

| | | | |
|---|---|---|---|
| 527735 | 7/1956 | Canada | 38/96 |
| 7310978 | 10/1974 | France | 38/96 |

*Primary Examiner*—Andrew M. Falik
*Attorney, Agent, or Firm*—Andsel Group

[57] ABSTRACT

An electric iron stand having a vertically oriented rear wall member, an electric support platform, and a clamping leg. The support platform extends from the front wall surface of the rear wall member at a predetermined height intermediate its top and bottom edges. The clamping leg has its rear end hingedly attached to the bottom edge of the rear wall member to form a space into which can be slid the top horizontal member of an ironing board. The rear wall surface of the rear wall member has a timer that is connected to a power outlet therein to which the plug of the electrical iron may be removably connected.

4 Claims, 1 Drawing Sheet

CLAMP TYPE ELECTRIC STEAM IRON STAND

BACKGROUND OF THE INVENTION

The invention relates to electric irons and more specifically to a stand upon which a hot electric iron may be placed.

Since the invention of the electric iron there have been all too many instances where electric irons have been absent mindedly left unattended and everything from simple scorching of a garment to setting a home ablaze have occured. Hot electric irons generate enough heat, if left unattended, to start a fire.

Electric irons are heavy and, because of the shape, can be upset and cause an accident. An upset iron can severely burn a table, the floor, a piece of furniture or even an unsuspecting person. Persons in a hurry to get to work will take time to iron a piece of clothing but do not wait until the iron cools before putting it away. The hot iron is left to possibly be knocked over, or it is put away in a heated condition, giving rise to a potential fire.

It a purpose of the invention to allow for timer controlled storage of an electric iron. It is also a purpose of the invention to hold an electric iron in such a manner so as to nearly preclude the possibility of dropping or causing an iron to fall.

It is another purpose of the instant invention to provide means to maintain a safe distance from the heated surface of an iron from all nearby surrounding areas.

It is an additional purpose of the instant invention to provide a means of clamping or affixing the electric iron stand onto a standard ironing board surface.

SUMMARY OF THE INVENTION

Applicant's novel electric iron stand has been designed to enable users to safely store and use an electric iron. The device has an electric iron support platform for the purpose of keeping a hot iron from unwanted contact with other objects. The support platform is vertically spaced from a clamping leg to provide a recess into which the edge of an ironing board can be slipped into. The clamping leg can also be used as a support base, setting upon a counter or table and keeping the heated iron surface from contact with the resting surface.

The electric iron support platform of the instant invention has a resilient bevel contoured side flange that extends upwardly from the opposite lateral side edges thereof. These side walls are contoured to fit the shape of an electric iron. These resilient beveled contoured side walls will keep an iron from slipping out of the holder or falling.

Applicant's novel device further comprises an electronic timer control and timed power outlet. The timer control and outlet are mounted on the rear wall surface of the vertically oriented rear wall member, immediately behind the electric iron support platform. An iron can be electrically controlled by means of the timer of the invention. User simply plugs the electric iron into the timer controlled outlet in lieu of plugging directly into the wall outlet. Should a user forget to turn off an iron the timer will control the power to the iron and stop power at a predetermined time.

DESCRIPTION OF THE PREFERRED EMBODIMENT

Figure 1:
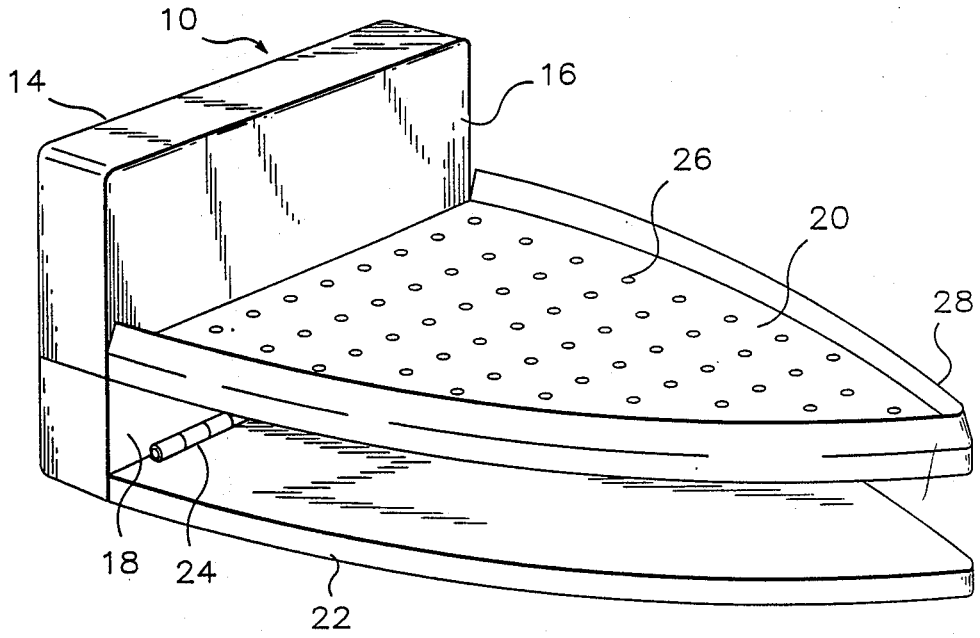
FIG. 1 is a side perspective view of applicant's novel electric iron stand.

Applicant's novel electric iron stand will now be described by referring to FIGS. 1–4 of the drawings. The electric iron stand is generally designated numeral 10. Electric iron stand 10 has a vertically oriented rear wall member 14 having a top portion 16 and a bottom portion 18. Electric iron support platform 20 extends out from the front wall surface of rear wall member 14 intermediate top portion 16 and bottom portion 18. Clamping leg 22 has its rear end attached by hinges 24 to the front wall surface of rear wall member 14 adjacent its bottom end.

Electric iron support platform 20 is made of a heat resistant material. It has a plurality of apertures 26. The contour of support platform 20 and clamping leg 22 are substantially identical and they have a pie-shaped configuration. Extending upwardly from the side edges of electric iron support platform 20 are resilient bevelled contoured side walls 28.

Figure 2:
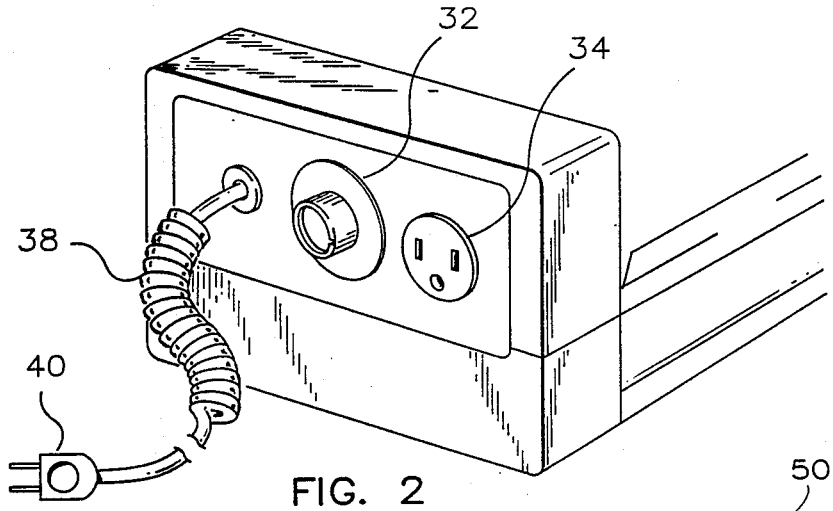
FIG. 2 is a perspective view that illustrates the rear of the vertically oriented rear wall member.

The rear surface of rear wall member 14 is illustrated in FIG. 2. A timer 32, and a timed electrical power outlet 34 are mounted in the top portion 16. An electrical connector 38 having a plug 40 in its a one end is plugged into wall socket.

Figure 3:
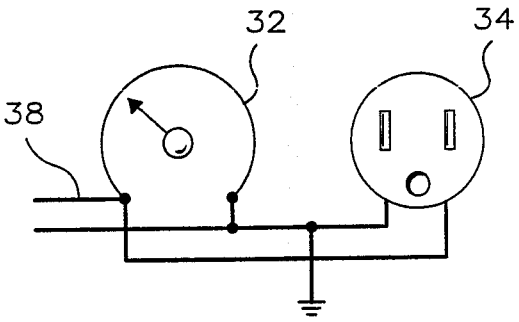
FIG. 3 illustrates the electrical circuit of the timer and timed electric power outlet located within the top portion of the rear wall member.
Figure 4:
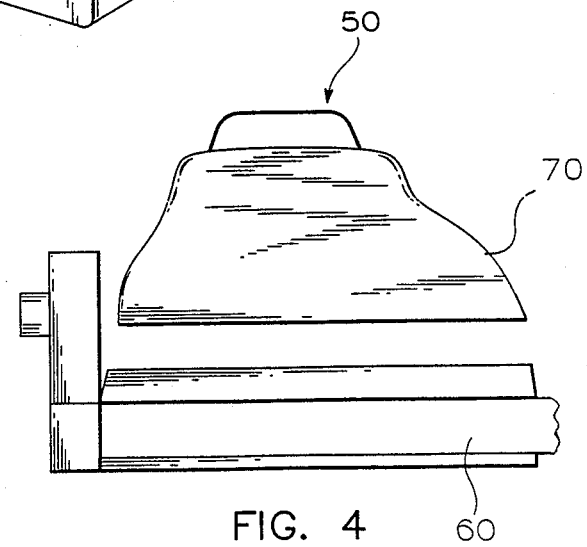
FIG. 4 is a side elevation view illustrating an iron and the manner in which it is received in the electric iron stand which would be mounted on an ironing board.
Figure 5:
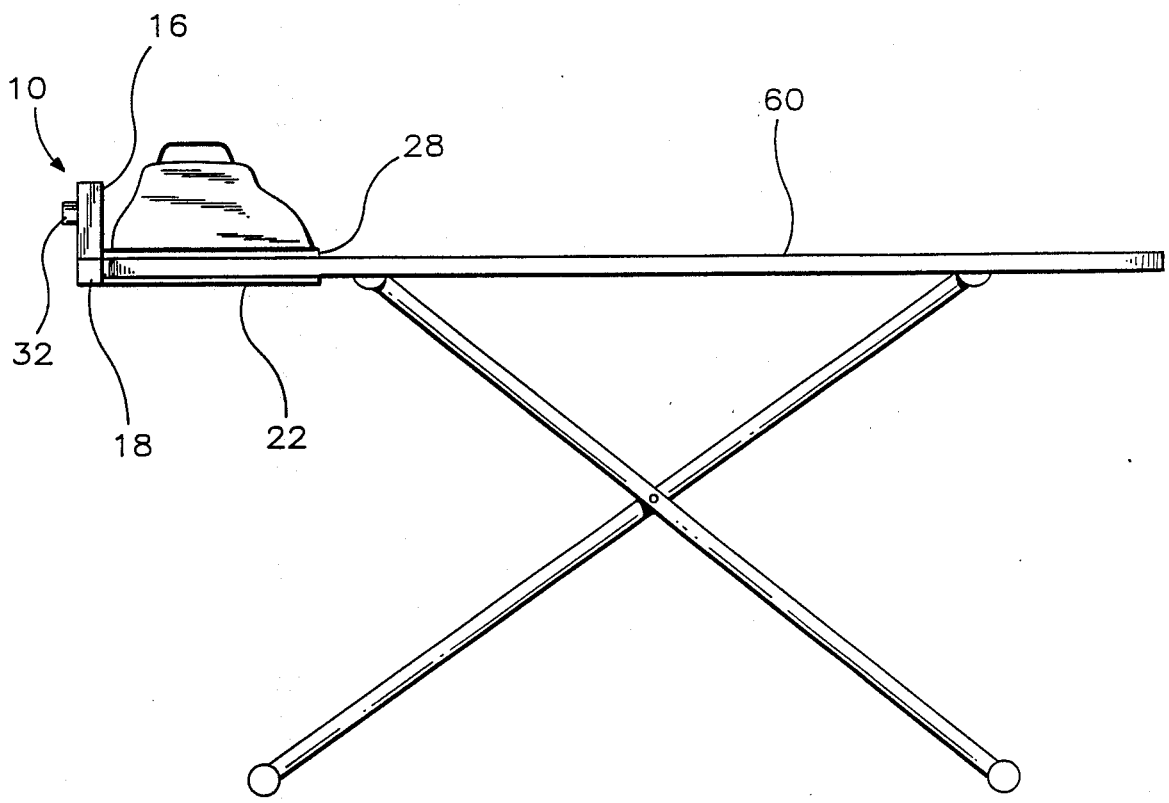
FIG. 5 is a side elevation view illustrating the electric iron stand mounted on an ironing board.

An electric iron 50 is illustrated in FIG. 3 prior to its being inserted into the electric iron stand 10. The stand itself is captured on ironing board 60. In FIG. 4, a schematic illustration shows a fire retardant cover 70 covering iron 50 and electric iron support platform 20.

The drawings as shown and thusly described represent the preferred embodiment of the invention. It would be obvious to one skilled in the art that various changes and modifications, simple or complex, could be made to the preferred embodiment which would alter its appearance but not the scope, spirit and intention of the invention. It is the intention of the inventor to preclude the occurence of such emulations in spirit or scope through the following claims.

What is claimed is:

1. An electric iron stand comprising:

a vertically oriented rear wall member having a top edge, a bottom edge and a front wall surface, said rear wall member having a top portion and a bottom portion;

a horizontally oriented electric iron support platform having a front end and a rear end, the rear end of said support platform being rigidly attached to the front wall surface of said rear wall member at a height intermediate its top portion and its bottom portion, said electric iron support platform having resilient bevel contoured side wall flanges extending upwardly from its lateral sides for detachably capturing an electric iron therebetween; and an elongated clamping leg having a front end and a rear end, said rear end being secured to the front wall surface of said rear wall member adjacent its bottom edge.

2. An electric iron stand as recited in claim 1 wherein said electric iron support platform is made of heat resistant material.

3. An electric iron stand as recited in claim 1 wherein said electric iron support platform has a plurality of cooling apertures.

4. An electric iron stand as recited in claim 1 further comprising a fire retardant cover.

* * * * *